US011053766B2

(12) United States Patent
Baker et al.

(10) Patent No.: US 11,053,766 B2
(45) Date of Patent: Jul. 6, 2021

(54) WIRELINE BLIND SHEAR RAM

(71) Applicant: Hydril USA Distribution LLC, Houston, TX (US)

(72) Inventors: Brian Scott Baker, Houston, TX (US); Kevin Sweeney, Houston, TX (US); Andrew Ingram, Houston, TX (US); Jamie Gamble, Houston, TX (US)

(73) Assignee: HYDRIL USA DISTRIBUTION LLC, Houston, TX (US)

( * ) Notice: Subject to any disclaimer, the term of this patent is extended or adjusted under 35 U.S.C. 154(b) by 171 days.

(21) Appl. No.: 16/369,859

(22) Filed: Mar. 29, 2019

(65) Prior Publication Data

US 2019/0309596 A1 Oct. 10, 2019

Related U.S. Application Data

(60) Provisional application No. 62/655,485, filed on Apr. 10, 2018.

(51) Int. Cl.
*E21B 33/06* (2006.01)

(52) U.S. Cl.
CPC ..... *E21B 33/063* (2013.01)

(58) Field of Classification Search
CPC ..... E21B 29/04; E21B 33/062; E21B 33/063
See application file for complete search history.

(56) References Cited

U.S. PATENT DOCUMENTS 3,196,538 A 7/1965 Zachman
4,081,027 A 3/1978 Nguyen
4,132,265 A * 1/1979 Williams, Jr. ..... E21B 29/08 166/55
4,537,250 A * 8/1985 Troxell, Jr. ..... E21B 29/08 166/55
4,618,269 A 10/1986 Badrak
4,685,521 A * 8/1987 Raulins ..... E21B 29/04 166/341
5,803,431 A 9/1998 Hoang
6,244,336 B1 * 6/2001 Kachich ..... E21B 33/063 166/55
6,414,258 B1 7/2002 Amano
7,137,610 B2 * 11/2006 Lam ..... E21B 33/062 251/1.3
7,703,739 B2 * 4/2010 Judge ..... E21B 33/063 251/1.3

(Continued)

OTHER PUBLICATIONS

International Search Report and Written Opinion dated Jun. 10, 2019 in corresponding PCT Application No. PCT/US19/24886.

*Primary Examiner* — Shane Bomar
(74) *Attorney, Agent, or Firm* — Hogan Lovells US LLP

(57) ABSTRACT

A shear ram system includes an upper block positioned to transition from a first location outside a bore to a second location within the bore, the upper block including a blade control arm having a first contact surface. The shear ram system includes a lower block positioned to transition from the first location outside the bore to the second location within the bore, the lower block including a second contact surface proximate the first contact surface. The shear ram system includes a progressive gap between the first contact surface and the second contact surface larger at a first end than at a second end such that a first gap distance at the first end is greater than a second gap distance the second end.

20 Claims, 10 Drawing Sheets

(56) References Cited

U.S. PATENT DOCUMENTS

| | | | | |
|---|---|---|---|---|
| 9,249,643 | B2 * | 2/2016 | Melancon | E21B 33/063 |
| 10,443,336 | B2 * | 10/2019 | Ellison | E21B 33/063 |
| 2004/0003919 | A1 | 1/2004 | Johnson | |
| 2008/0105341 | A1 | 5/2008 | Huff | |
| 2010/0152901 | A1 * | 6/2010 | Judge | E21B 33/062<br>700/275 |
| 2012/0043068 | A1 | 2/2012 | Jahnke | |
| 2012/0318493 | A1 | 12/2012 | Carbaugh | |
| 2014/0048245 | A1 | 2/2014 | Yendell et al. | |
| 2014/0264099 | A1 | 9/2014 | Melancon | |
| 2017/0058627 | A1 | 3/2017 | Araujo | |
| 2017/0191337 | A1 | 7/2017 | Rey | |
| 2017/0362911 | A1 | 12/2017 | Read | |
| 2020/0032608 | A1 * | 1/2020 | Christopherson | E21B 29/08 |

* cited by examiner

WIRELINE BLIND SHEAR RAM

CROSS REFERENCE TO RELATED APPLICATIONS

This application claims priority to U.S. Provisional Application No. 62/655,485 filed Apr. 10, 2018 titled "WIRELINE BLIND SHEAR RAM," the disclosure of which is incorporated herein by reference in its entirety.

BACKGROUND OF THE DISCLOSURE

1. Field of the Disclosure

This disclosure relates in general to oil and gas tools, and in particular, to systems and methods for shearing lines or pipes.

2. Brief Description of Related Art

In oil and gas production, drilling and recovery may occur in high pressure environments where various tools may be utilized to control wellbore pressures. For example, a blowout preventer or the like may be arranged at an entrance to the wellbore. During operations, equipment may pass through the blowout preventer and, if necessary, the blowout preventer may be utilized to seal the wellbore to reduce the likelihood of uncontrolled releases from the wellbore. One component of the blowout preventer may be a shear ram. The shear ram may be a hydraulically driven component that drives cutting edges of two components toward one another to contact and shear the components between, such as wirelines or piping. However, the shear rams may be subject to excessive stresses during operation, and as a result, may wear out quickly. Repairs may be expensive or time consuming.

SUMMARY OF THE DISCLOSURE

Applicants recognized the problems noted above herein and conceived and developed embodiments of systems and methods, according to the present disclosure, for shear rams.

In an embodiment, a shear ram system includes an upper block coupled to a first arm, the upper block positioned to transition from a first location outside a bore to a second location within the bore, the upper block including a blade control arm having a first contact surface extending along a first length. The shear ram system also includes a lower block coupled to a second arm, the lower block positioned to transition from the first location outside the bore to the second location within the bore, the lower block including a second contact surface positioned proximate the first contact surface. The shear ram system further includes a progressive gap between the first contact surface and the second contact surface, the progressive gap being larger at a first end than at a second end such that a first gap distance at the first end is greater than a second gap distance the second end.

In another embodiment, a blowout preventer includes a tubular fluidly coupled to a wellbore, the tubular having a bore; and a pressure control device positioned to extend into the bore. The pressure control device includes an upper block arranged proximate the bore in a first position and within the bore in a second position, the upper block including a blade control arm having a first contact surface. The pressure control device also includes a lower block arranged proximate the bore in a first position and within the bore in a second position, the lower block including a second contact surface that faces the first contact surface. The pressure control device further includes a progressive gap between the first contact surface and the second contact surface, the progressive gap being larger at a first end than at a second end such that a first gap distance at the first end is greater than a second gap distance the second end.

In an embodiment, a blowout preventer includes a tubular fluidly coupled to a wellbore, the tubular having a bore and a pressure control device positioned to extend into the bore. The pressure control device includes an upper block adapted to translate into the bore, the upper block including a first contact surface. The pressure control device also includes a lower block adapted to translate into the bore, the lower block including a second contact surface, wherein the first contact surface and the second contact surface are opposite facing. The pressure control device further includes a progressive gap between the first contact surface and the second contact surface, the progressive gap formed when the first contact surface and the second contact surface complete a shearing stroke, wherein a first gap distance at a first end of the first contact surface is greater than a second gap distance at a second end of the first contact surface.

BRIEF DESCRIPTION OF THE DRAWINGS

The present technology will be better understood on reading the following detailed description of non-limiting embodiments thereof, and on examining the accompanying drawings, in which.

DETAILED DESCRIPTION OF THE PREFERRED EMBODIMENT

Figure 1:
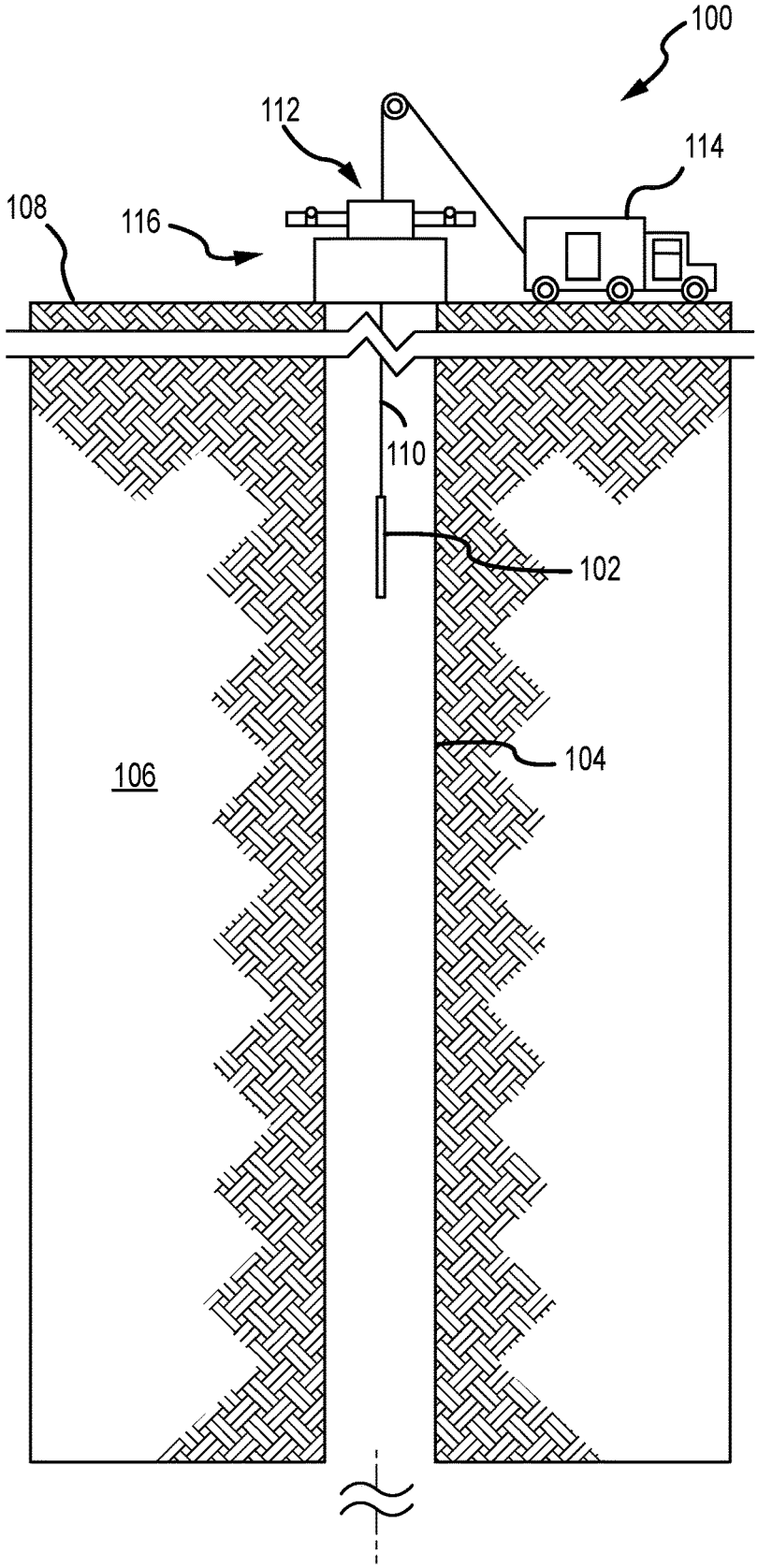
FIG. 1 is a side elevation view of an embodiment of a wellbore system, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present invention are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Embodiments of the present disclosure include systems and methods to keep the cutting edges of a wireline blind shear ram in close proximity to one another during a wireline (or submersible that includes wireline as a component) shearing operation.

For example, the design of the present technology can use high bending capacity arms on an upper carrier that interface with landing surfaces on a lower carrier. These control surfaces allow the lower carrier to be lifted upwards so that the blade edges on the lower and upper carriers are positioned by as few machined surfaces as possible (e.g., a limited number of machined surfaces). This arrangement helps to provide a close clearance between the blades of the upper and lower carriers. In addition, in some embodiments replaceable wear inserts can be located on the arms of the upper ram block. Such replaceable wear inserts can be composed of softer materials than the ram arms, and are intended to take the brunt of wear and damage during cycling and shearing. Recessed areas can be machined or otherwise introduced into the lower ram block to help the arms of the upper carrier disengage from the lower block after shearing has occurred and the rams are fully closed. Such a recess is advantageous because when the wellbore pressure deflects the rams upwards the arms of the upper carrier will not be in the load path. Although the present technology as shown and described herein includes arms attached to the upper carrier and recesses defined by the lower carrier, it is to be understood that other appropriate configurations can fall within the scope of the technology. For example, in some embodiments the arms can be associated with the lower carrier and the recess with the upper carrier.

The present technology provides many advantages of known systems. For instance, in known systems cutting small diameter wire typically requires adjustment or tightening of the gap between the upper and lower carrier blades. The present technology reduces or eliminates the need to adjust or tighten the blades because the geometry of the upper carrier arms and the landing surfaces on the lower carry maintains a tight gap between the blades without the need for such adjustment.

Another advantage over known systems is that the present technology does not require an interference fit between components, and therefore does not wear down as quickly as known systems in the field. This allows for relatively inexpensive and efficient field replacements to be made to maintain the equipment.

In addition, known systems include small guide pins that connect into holes in the lower block. These pins remain in the load path during pressurization, and can incur damage from deflection of the components under pressure. In contrast, the design of the present technology may engage the controlling arms only during the shearing sequence. However, it should be appreciated that engagement of the controlling arms may also occur at other times. Once shearing is completed, the arms are released and remain out of the load path during pressurization. This helps to ensure that no damage or accelerated wear occurs.

Another advantage to the present technology is that it uses intentional wear items to control the service life of more expensive components. For example, there is a phased sequence of controlling surfaces that allow for a tight blade fit up during shear and then a subsequent release of those surfaces during pressurization to prevent unnecessary damage and/or wear to the critical components. The design advantageously does not rely on interference fit between components like other known systems. Such known interference fits reduce life of the components.

Embodiments may also include one or more features that enable centralization of a wellbore component, such as a wireline, and also a reduction in stress. Blades used on shearing rams may not cover the full wellbore diameter because of an interface dilemma with the sealing system. Normally, this is of little to no consequence because almost all drillpipe is large enough to be centered by the blade alone. However, when wireline is being sheared, it is small enough to fall outside of the blade range, and as a result, a centralizer may be used to bring it back into position. Moreover, ram block stress is generally derived from bearing stress loads on the surfaces between the upper and lower block. Problems can occur when the high bearing stresses are adjacent to critical surfaces such as seal surfaces, hardfacing, and stress concentrations. This centralizing feature also serves as a bearing surface between the upper and lower blocks. The surface is located far away from any critical surfaces and therefore helps to guard those sensitive areas from damage.

Embodiments of the present disclosure include a shear ram system that includes a progressive gap between contact surfaces of an upper block and a lower block. The progressive gap is narrower proximate a body of the upper block and larger at an end of a blade control arm. In various embodiments, the progressive gap is particularly selected and sized to accommodate pressures, such as wellbore pressures, which may deflect the blade control arm toward the lower block, which could potentially damage or wear the components. By maintaining the progressive gap, or a substantially constant gap when pressure is within the system, frictional forces between various contact surfaces may be reduced, which may increase the life of components of the system. Additionally, the progressive gap provides efficient use of the available material. For example, if excessive material is used (e.g., more than a threshold or baseline amount), the design may be compromised in regard to stress. The progressive contour is particularly selected to strike a balance between the gap to disconnect the arms when desired and maintaining material enough for proper safety factors and product service life. Furthermore, in embodiments, one or both of the upper block and the lower block may include a centralizer feature to position wellbore components for shearing via the shear ram system, as well as to reduce stresses as various locations.

FIG. 1 is a schematic side view of an embodiment of a wellbore system 100 that includes a tool 102 (which may be part of a tool string) being lowered into a wellbore 104 formed in a formation 106 from a surface location 108. The illustrated wellbore system 100 may be referred to as a wireline system because the tool 102 is conveyed on a cable 110, such as an electric wireline. In various embodiments, the electric wireline may transmit electric signals and/or energy from the surface location 108 into the wellbore, for example to provide operational power for the tool 102 and/or to transmit data, such as data obtained from sensors arranged on the tool 102. In various embodiments, the tool 102 may be utilized to perform downhole logging operations, such as an imaging tool, a resistivity tool, a nuclear tool, or any other logging tool that may be used in a downhole environment.

The wellbore system 100 includes a wellhead assembly 112, shown at an opening of the wellbore 104, to provide pressure control of the wellbore 104 and allow for passage of equipment into the wellbore 104, such as the cable 110 and the tool 102. In this example, the cable 110 is a wireline being spooled from a service truck 114. The wellhead assembly 112 may include a blowout preventer (BOP) 116 (e.g., pressure control device) that comprises shear rams that may be utilized to shear components extending through BOP 116. As will be described below, in various embodiments the shear rams may be energized to move from a position outside of a bore of the BOP 116 to a position within the bore of the BOP 116. The shear rams may cut the cable 110 in the illustrated embodiment to thereby facilitate closure of the wellbore 104. Furthermore, it should be appreciated that the seal rams may also shear and seal across drill pipe, casing, shear subs or combinations of pipe, control lines, tubing, hoses, and/or wireline. Accordingly, while embodiments herein may be described with respect to shearing the cable 110, it should be appreciated that various other downhole components may be sheared that features of the present disclosure may facilitate and improve those shearing operations as well.

Figure 2:
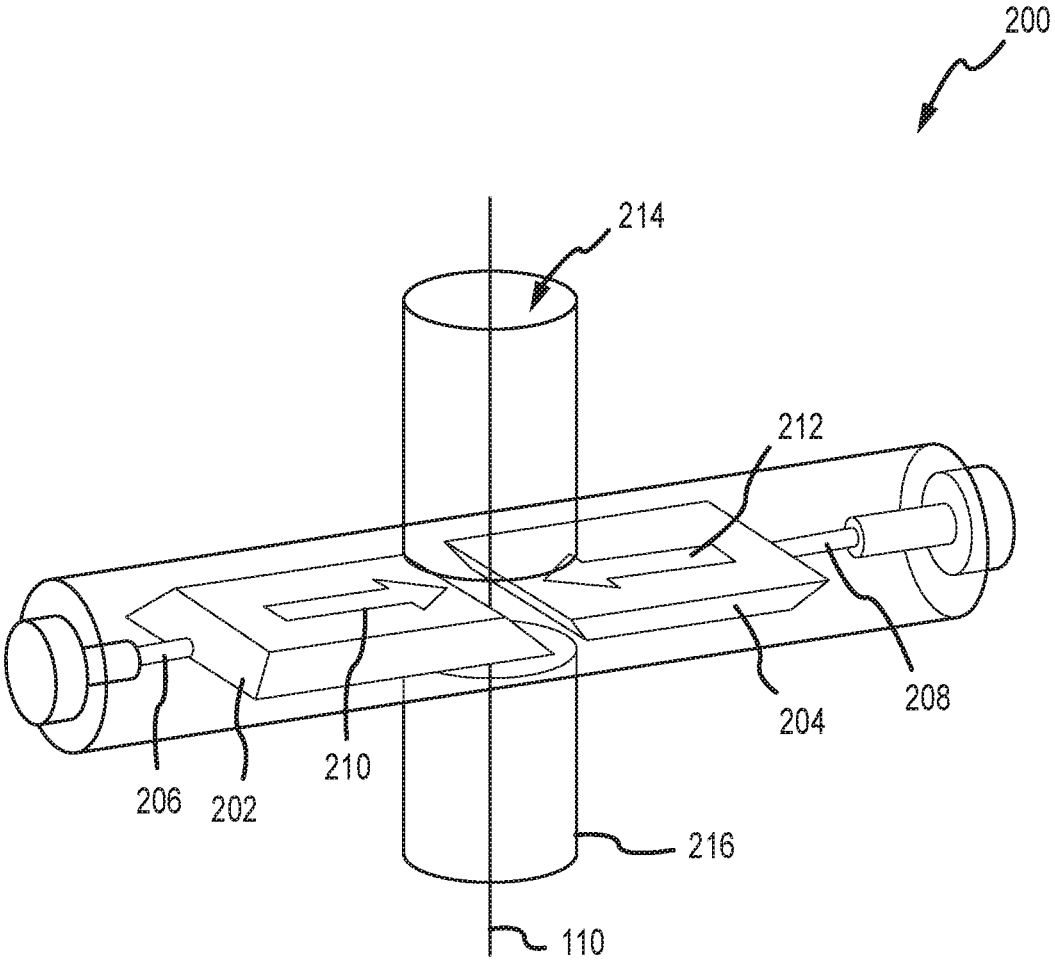
FIG. 2 is a schematic perspective view of an embodiment of a shear ram system, in accordance with embodiments of the present disclosure.

FIG. 2 is a schematic isometric view of an embodiment of a shear ram system 200 (e.g., pressure control device), which may be incorporated into or associated with a BOP (for example BOP 116). In the illustrated embodiment, the shear ram system 200 includes a pair of blind shear rams 202, 204. The blind shear rams 202, 204 may be referred to as an upper block and lower block, respectively. Each of the blind shear rams 202, 204 is coupled to arm 206, 208 that facilitates radial movement of the rams 202, 204 in a first direction 210 and a second direction 212. In operation, the rams may be arranged outside a bore 214 of a wellbore tubular 216, which may be part of the BOP, and when activated may extend into the bore 214. In the illustrated embodiment, the cable 110, which may be a wireline, is arranged within the bore 214. As will be described below, embodiments of the present disclosure may facilitate shearing the cable 110. However, as noted above, other downhole components may also be sheared and/or sealed using embodiments of the present disclosure.

Figure 3:
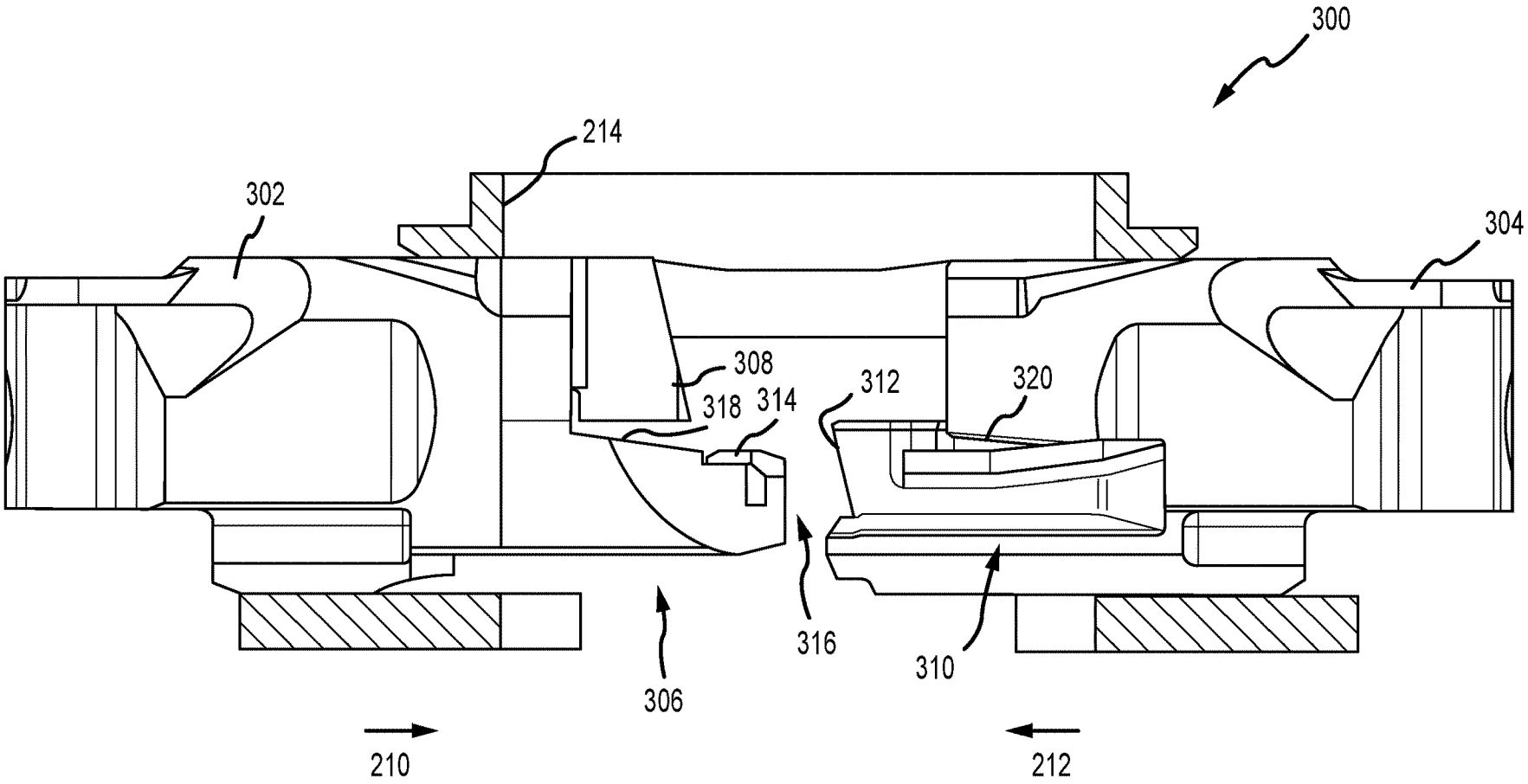
FIG. 3 is a side elevational view of an embodiment of a shear ram system, in accordance with embodiments of the present disclosure.

FIG. 3 is a schematic side view of an embodiment of a shear ram system 300, which may be included within a BOP or other pressure control device associated with a wellbore, as described above. The illustrated shear ram system 300 is positioned extending at least partially into the bore 214. It should be appreciated that like numbers may be used for like components for simplicity, but that such numbering is not intended to limit the disclosure. Furthermore, it should be appreciated that various features from one or more embodiments depicted herein may be utilized across embodiments.

The illustrated shear ram system 300 includes an upper block 302 and a lower block 304, which may also be referred to as rams. In the illustrated embodiment, the upper block 302 and the lower block 304 are blind rams. As would be appreciated by one skilled in the art, a blind shear ram may operate to seal a wellbore, even when the wellbore is occupied by an object, such as a wireline or drilling string. While embodiments described herein may refer to a blind shear ram, it should be appreciated that other rams, such as a ripe ram or dual offset ram, may also be utilized.

As shown, the upper block 302 includes a blade control arm 306 at a lower portion thereof and a blade 308 opposite the blade control arm 306. In operation, the upper block 302 is driven in the first direction 210 toward the lower block 304 such that the blade control arm 306 is nested within a pocket 310 formed in the lower block 304. The lower block 304 further includes a second blade 312, which may be utilized to sever the wireline and/or pipe arranged within the bore 214.

In the illustrated embodiment, the upper block 302 includes a wear insert 314 arranged within a recess 316 formed within the blade control arm 306. The wear insert 314 may be formed from a material that is softer than other components of the upper block 302, such as the wear control 306, blade 308, a lower block contact surface, the second blade 312, or the like. As will be described below, in operation at least a portion of the blade control arm 306, such as the wear insert 314, may contact at least a portion of the lower block 304. The wear insert 314 may be utilized to accept any wear and/or degradation from the contact and, thereafter, serve as a replaceable component that may be easily repaired.

The embodiment of FIG. 3 includes an upper block contact surface 318, which is illustrated as extending along at least a portion of the perimeter of the blade control arm 306. The upper block contact surface 318, or at least a portion thereof, may engage at least a portion of a lower block contact surface 320, which extends along at least a portion of a perimeter of the pocket 310. As will be described below, it may be desirable or reduce or limit the total contact between the upper block 302 and the lower block 304 to reduce wear or damage to the components. Accordingly, embodiment described herein may include a progressive gap arranged between the upper block 302 and the lower block 304 to reduce wear between the components and/or to direct wear to particular components, such as the wear insert 314.

Figure 4:
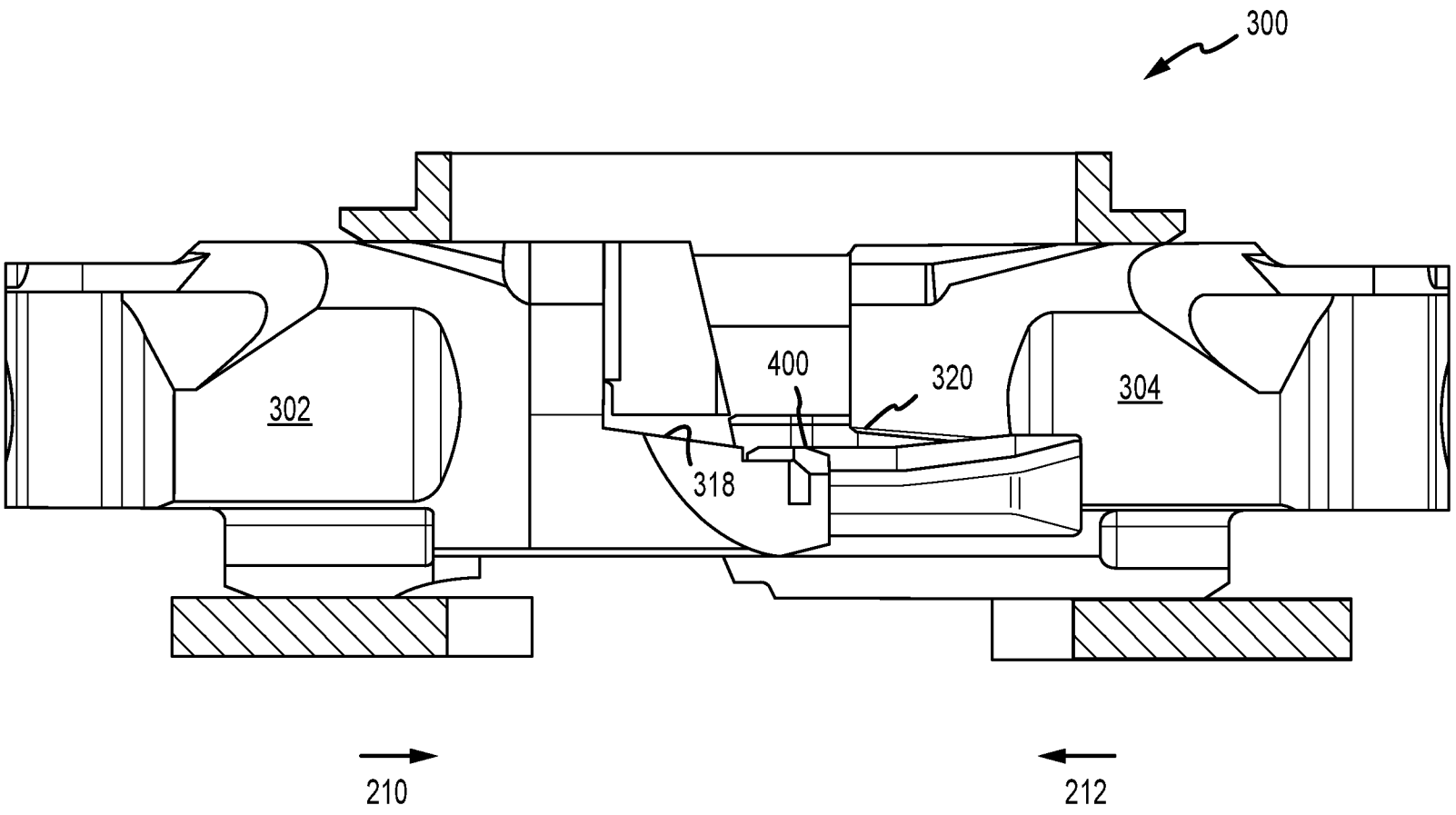
FIG. 4 is a side elevational view of an embodiment of a shear ram system at a first portion of a shearing stroke, in accordance with embodiments of the present disclosure.

FIG. 4 is a schematic side view of an embodiment of the shear ram system 300 where the upper block 302 is moving into contact with the lower block 304, for example, along at least portions of the respective contact surfaces 318, 320. The position illustrated in FIG. 4 may be described as part of a shearing stroke that brings the upper block 302 and the lower block 304 together. In the illustrated embodiment, a first contact point 400 is formed between the lower block 304 and the wear insert 314. It should be appreciated that, when referring to contact points, the point may include a surface or a region and is not necessarily restricted to a single, concentrated location. In the illustrated embodiment, the upper block 302 is moving in the first direction 210 while the lower block 304 is moving in the second direction 212. As a result, there may be a sliding or friction force at the contact point 4002. As described above, it may be desirable for the frictional forces to be concentrated or otherwise focused on the wear insert 314, as the wear insert 314 may be easier to replace and/or repair when compared to other components of the upper block 302 and/or the lower block 304.

Figure 5:
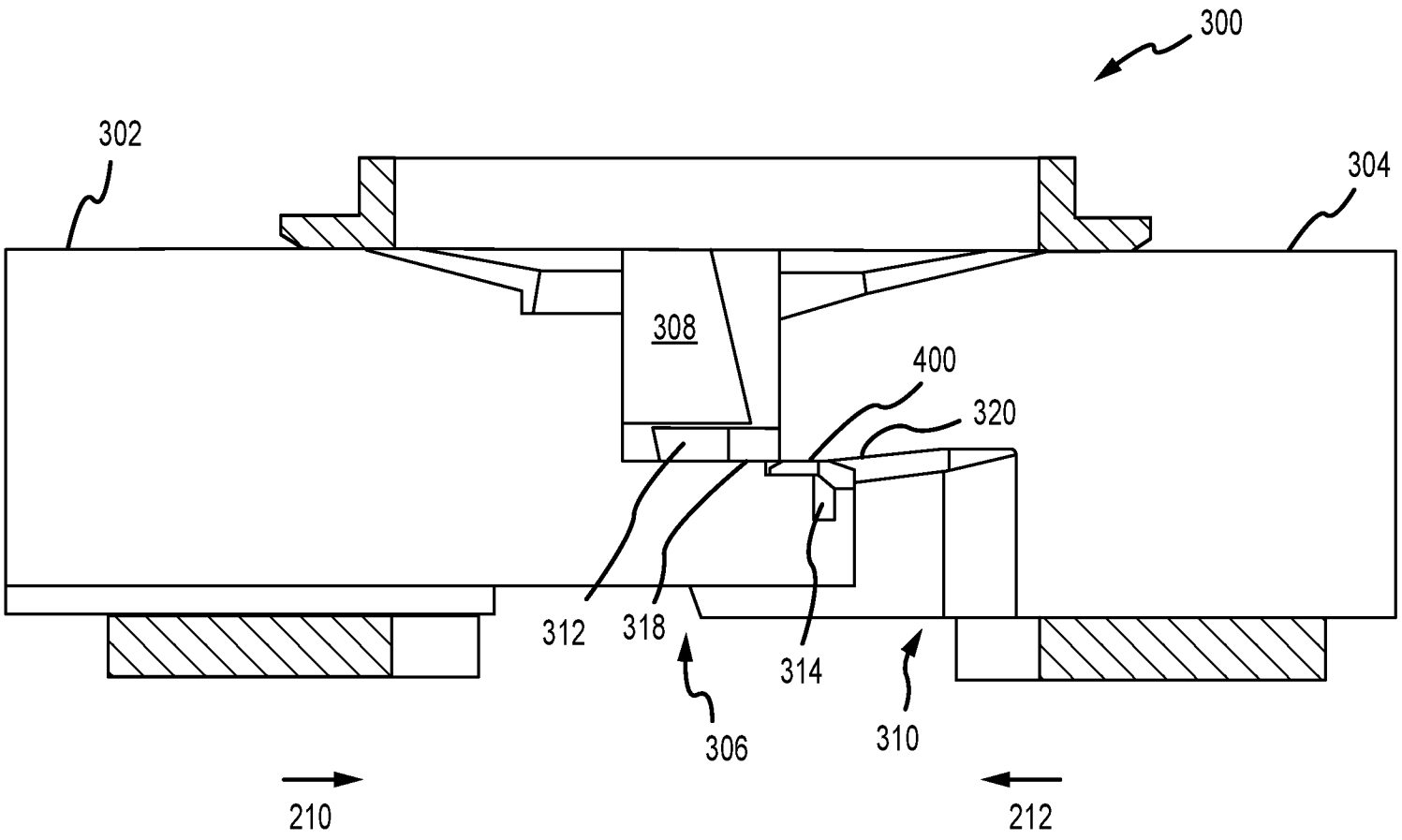
FIG. 5 is a side elevational view of an embodiment of a shear ram system at a second portion of a shearing stroke, in accordance with embodiments of the present disclosure.

FIG. 5 is a schematic side view of an embodiment of the shear ram system 300 illustrating a continued sequence of the shearing stroke. As illustrated, the first contact point 400 continues to extend along the blade control arm 306 as the blades 308, 312 overlap. The wear insert 314, in the illustrated embodiment, is arranged to maintain a gap between at least a portion of the upper block 302 and a portion of the lower block 304. For example, as will be described in more detail below, in various embodiments the wear insert 314 may extend a greater vertical extent, from a bottom of the upper block 302, than other portions. As a result, the wear insert 314 may contact the lower block 304 before other portions of the upper block 302. Additionally, that greater vertical extend may provide further separation between the components. In various embodiments, wear inserts 314 are replaceable and are composed of softer materials than the ram arms (e.g., the upper block 302 and the lower blocker 304), and are intended to take the brunt of wear and damage during cycling and shearing. The progressive gap, described below, may help the arms of the upper block 302 disengage from the lower block 304 after shearing has occurred and the rams are fully closed. This gap, and the presence of the wear inserts 314 to maintain the spacing between the components, is advantageous because when the wellbore pressure deflects the upper block 302 upwards the blade control arm 306 will not be in the load path.

Figure 6:
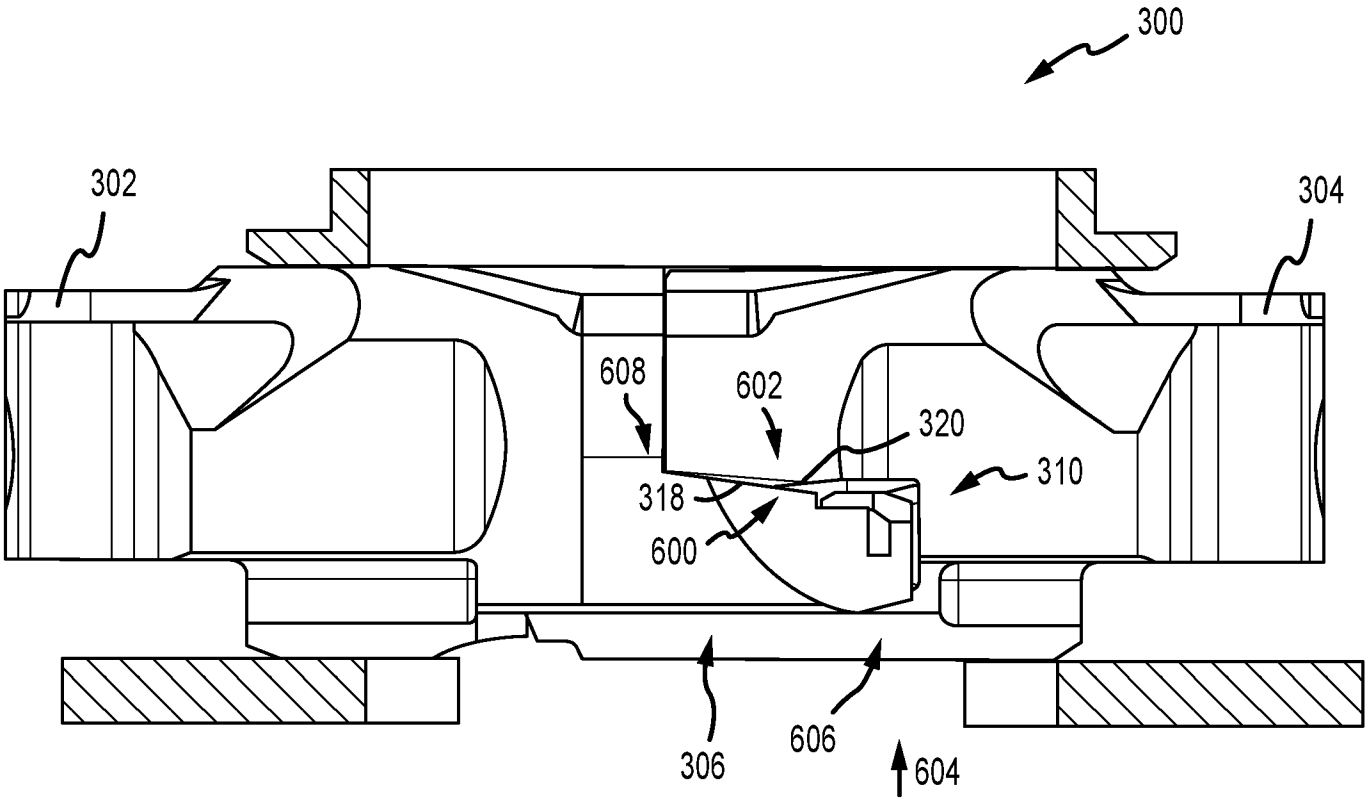
FIG. 6 is a side elevational view of an embodiment of a shear ram system at a third portion of a shearing stroke, in accordance with embodiments of the present disclosure.

FIG. 6 is a schematic side view of the shear ram system 300 at an end of the shear stroke where the blade control arm 306 is positioned within the pocket 310. As illustrated in FIG. 6, a progressive gap 600 is arranged along a length 602 of the blade control arm 306 along at least a portion of the upper contact surface 318. The progressive gap 600, as will be described below, enables deflection and movement of the blade control arm 306 in an upward direction 604, for example, due to a pressure or force from the wellbore. In various embodiments, the progressive gap 600 may not be uniform along the upper contact surface 318 and may be particularly selected to accommodate varying degrees of anticipated or expected movement of the blade control arm 306. For example, there may be more deflection at a far end 606 than a near end 608.

Figure 7:
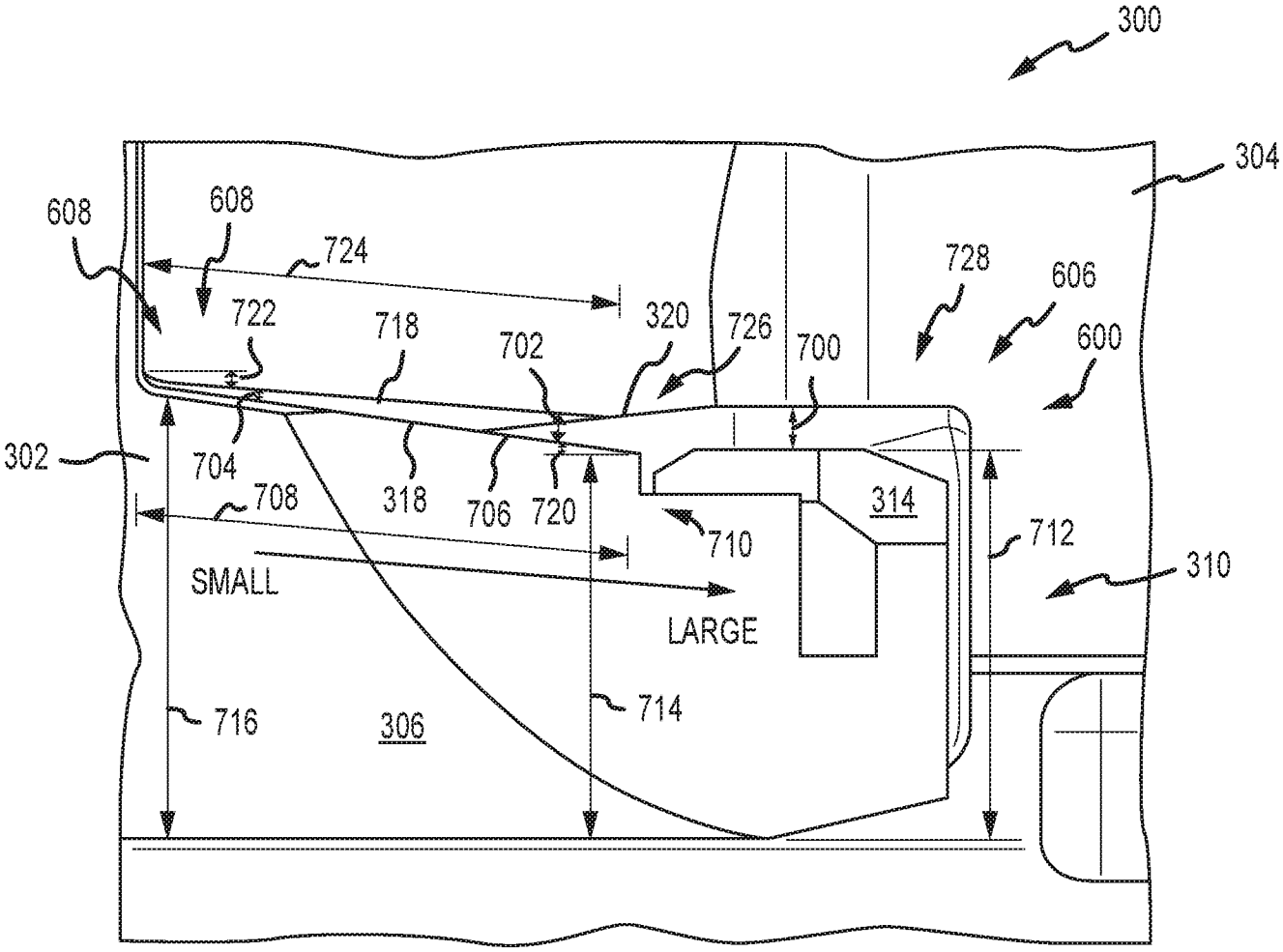
FIG. 7 is a detailed view of a blade control arm of a shear ram system, in accordance with embodiments of the present disclosure.

FIG. 7 is a partial detailed view of an embodiment of the shear ram system 300, illustrating the progressive gap 600. As illustrated in FIG. 7, the progressive gap 600 is larger at the far end 606 than the near end 608. That is, a first gap distance 700 between the wear insert 314 and the lower block 304 is larger than a second gap distance 702 and a third gap distance 704. In the illustrated embodiment, the second gap distance 702 is also larger than the second gap distance 704. Accordingly, the respective gap distances may be particularly selected in order to accommodate movement and or flexing of the blade control arm 306, for example, due to wellbore pressure that may apply a force to the blade control arm 306. As noted above, there may be larger flexing at the far end 606 than near end 608. For example, the far end 606 may be considered more of a cantilever, relative to the body of the upper block 302, than the near end 608, and as a result, forces have a greater impact on the far end 606.

In the illustrated embodiment, the blade control arm 306 includes a downwardly sloped surface 706 extending for a second length 708, which is less than the length 602 of the blade control arm 306. The slope of the surface 706 may be particularly selected based on a variety of factors, such as anticipated operating conditions, material forming the upper block 302, and the like. The illustrated downwardly sloped surface 706 terminates at a step 710, but it should be appreciated that a more gradual ending may be included toward the recess 316 that receives the wear insert 314. In the illustrated embodiment, a wear insert height 712 is larger than an ending height 714 of the downwardly sloped surface 706, but less than a starting height 716. However, in various embodiments, the respective heights may be adjusted.

The pocket 310 of the lower block 304 is shaped to receive the blade control arm 306 and includes a second downwardly sloped surface 718 arranged proximate the downwardly sloped surface 706. In the illustrated embodiments, an angle 720 of the downwardly sloped surface 706 is different than an angle 722 of the second downwardly sloped surface 718. As described above, this difference in angle may enable the progressive gap 720. The second downwardly sloped surface 718 has a third length 724, which is shorter than the second length 708. The second downwardly sloped surface 718 is connected to a transition 726, which is upwardly sloped, and further extends to a substantially planar surface 728. As illustrated, a portion of the transition 726 and planar surface 728 are aligned with the wear insert 314. Because the transition 726 is upwardly sloped, a greater gap distance 700 is enabled. As noted above with respect to the upper block 302, in various embodiments the components, dimensions, and the like of the lower block 304 may also be particularly selected based on operating conditions.

In various embodiments, the various gap distances 700, 702, and 704 may be particularly selected in order to maintain a substantially uniform gap distance between the blade control arm 306 and the lower block 304 (e.g., at least a portion of the lower contact surface 320). That is, after deflection, it may be desirable for the progressive gap 600 to be substantially equal along the length 602 of the blade control arm 306, as well as at the wear insert 314. However, it should be appreciated that maintaining the progressive gap 600 may also be desirable, as including any gap may reduce the likelihood of deformation and/or wear between at least a portion of the upper contact surface 318 and the lower contact surface 320. Additionally, the progressive gap 600 may be designed to enable efficient use of the available material. For example, if excessive material is used (e.g., more than a threshold or baseline amount), the design may be compromised in regard to stress. The progressive contour is particularly selected to strike a balance between the gap to disconnect the arms when desired and maintaining material enough for proper safety factors and product service life.

Figure 8:
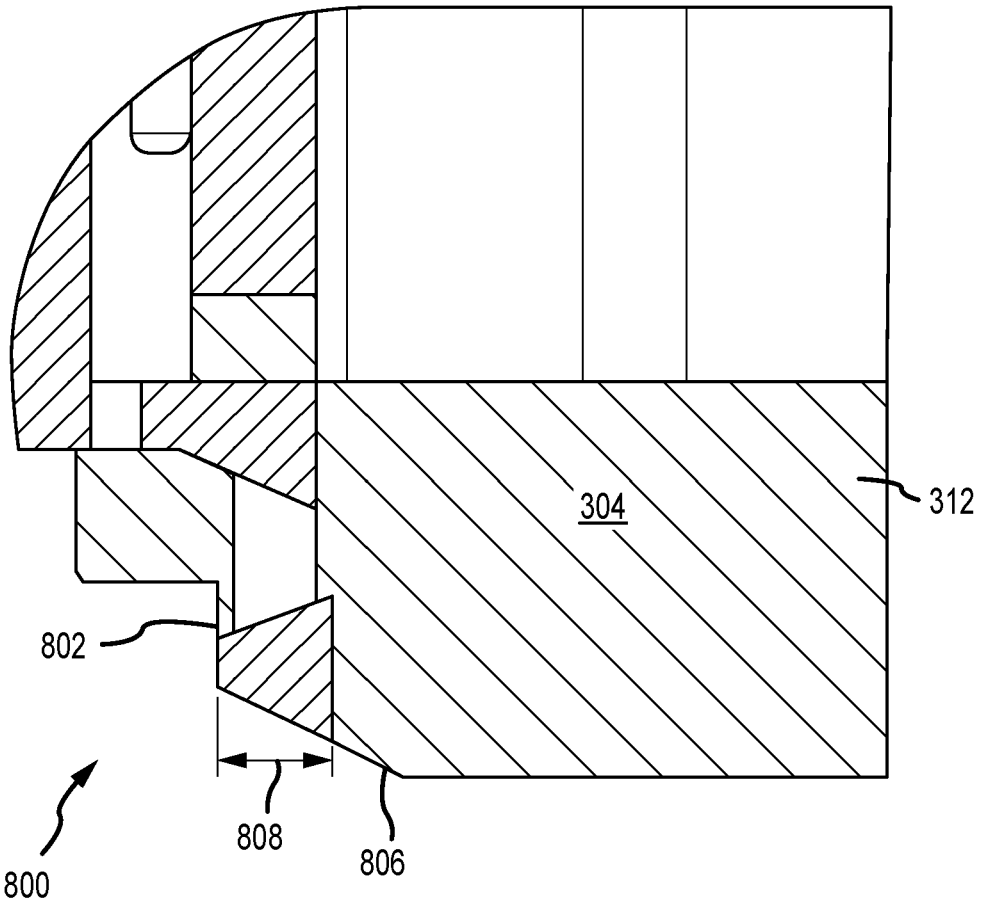
FIG. 8 is a cross-sectional view of an embodiment of a lower block of a shear ram system, in accordance with embodiments of the present disclosure.

While the above-described progressive gap 600 and wear insert 314 may be helpful to reduce wear between components of the shear ram system 300, in various embodiments it may be challenging to position small diameter components, such as the cable 110, within a region of the shear ram system 300 to enable the blades 308, 312 to shear the line. Accordingly, in various embodiments, one or more centralizing features may further be positioned proximate the above-described blade control arm 306. FIG. 8 is a front elevational view of an embodiment of the lower block 304 including a centralizing system 800 having a centralizer 802. It should be appreciated that a second centralizer is not pictured in FIG. 8, but may be arranged opposite the centralizer 802. As will be described below, the centralizer 802 may be an extension that is arranged along a face 806 of the lower block 304 to direct components away from the walls of the wellbore tubular and toward the blade 312 to facilitate the shearing operation.

As shown, the centralizer 802 is arranged below (relative to a direction of flow into the wellbore) the blade 312. Furthermore, the centralizer 802 illustrated in FIG. 8 has a wedge shape, which may also be described as a trapezoid or a triangle with one of the points cut off. It should be appreciated that a width 808 of the centralizer 802 may be particularly selected based on the bore size. For example, it may be desirable to arrange the centralizer 802 to scrape or be close to an inner diameter of the bore 214. As will be described below, while the illustrated cross-section of the centralizer 802 may appear to be substantially flat, a leading edge may include an angle to direct components, such as wirelines, toward the blade 312.

Figure 9:
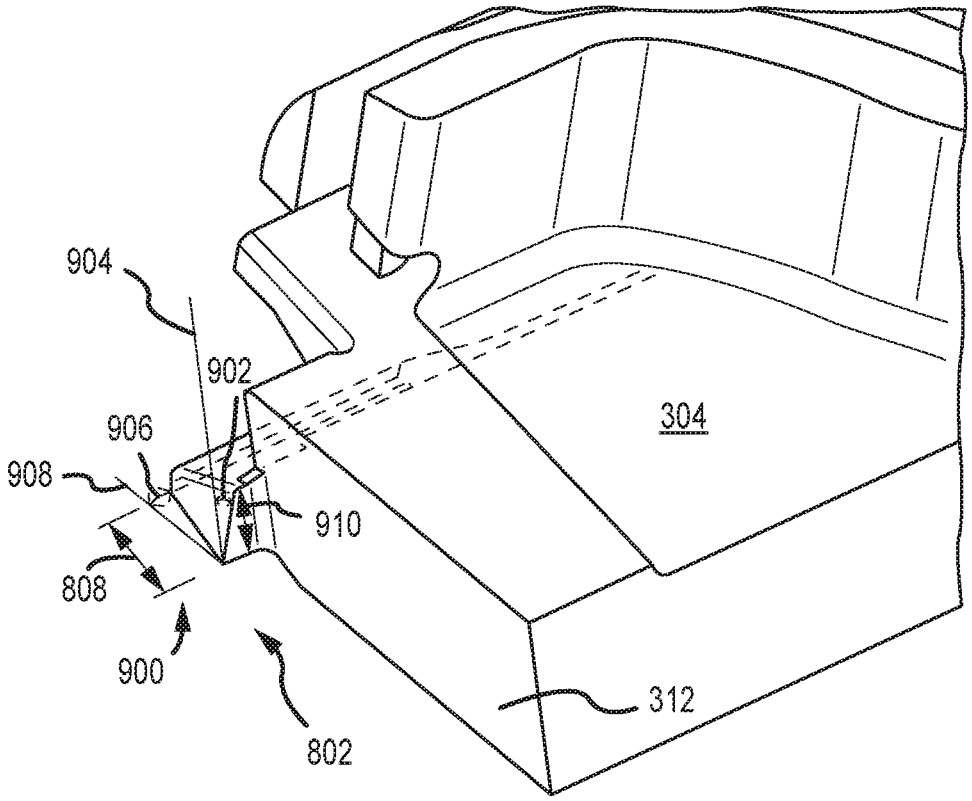
FIG. 9 is a perspective view of an embodiment of a lower block of a shear ram system, in accordance with embodiments of the present disclosure.

FIG. 9 is a perspective view of a portion of the lower block 304 including the centralizer 802. As described above, the centralizer 802 is arranged below a top of the blade 312 and extends radially outward by the width 808. A leading edge 900 is arranged at an angle along two axes. For example, a first angle 902 is illustrated with respect to a first axis 904 and a second angle 906 is illustrated with respect to a second axis 908. As a result, as the lower block 304 is moving through the bore 214, the wireline that may be captured by the centralizer 802 will be guided along the angled surface and toward the blade 312. It should be appreciated that, in various embodiments, the first angle 902 and/or the second angle 906 may be substantially aligned with the respective axes.

In the illustrated embodiment, the centralizer 802 includes a height 910, which may be particularly selected based on various factors, such as a size of the BOP. The height 910 may be selected, as least in part, as a ratio of other components of the lower block 304, such as the blade 312, but in other embodiments the height 910 may be designed separately. As will be described below, in operation the centralizer 802 may engage a slot formed in the upper block 302.

Figure 10:
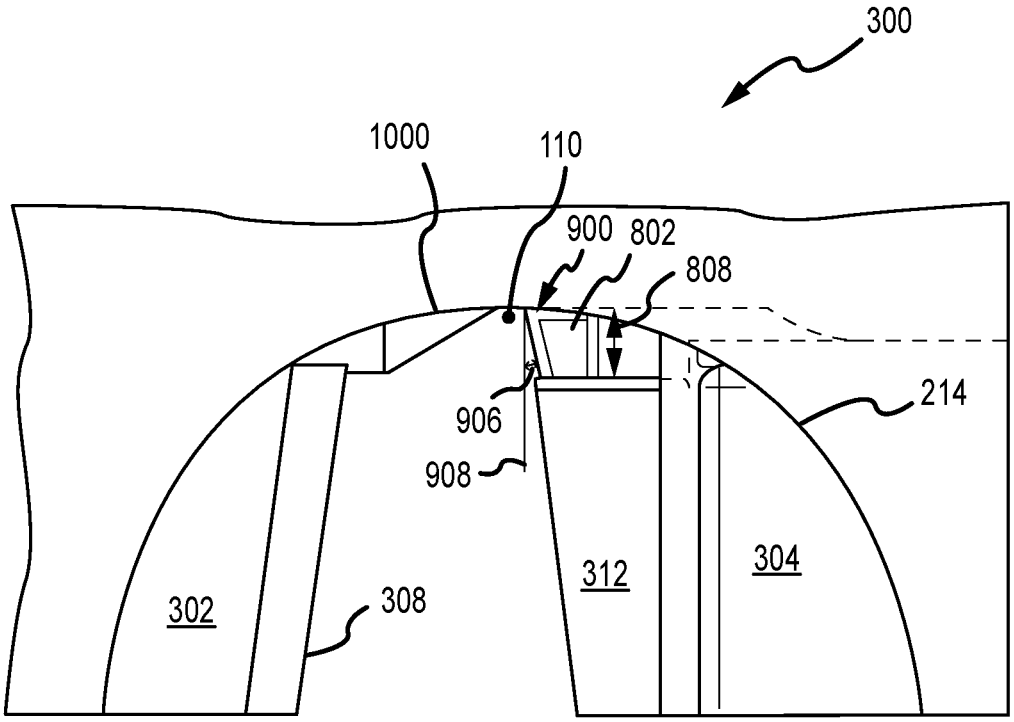
FIG. 10 is a top view of an embodiment of a shear ram system, in accordance with embodiments of the present disclosure.

FIG. 10 is a top schematic view of an embodiment of the shear ram system 300 where the centralizer 802 is positioned along an inner diameter 1000 of the bore 214 to engage the cable 110 arranged within the bore 214. The width 808 is arranged such that the centralizer extends toward the inner diameter 1000 to effectively collect the cable 110 and direct the cable, along the leading edge 900, toward the blade 312. In the illustrated embodiment, the second angle 906 is illustrative with respect to the second axis 908. As described above, the second angle 906 may be particularly selected based on various factors, such as the size of the bore. The second angle 906 guides the cable 110 toward the blade 312, which enables the shear ram system 300 to cut the cable 110. As the upper block 302 and lower block 304 come together, the centralizer 802 may be received within a slot formed in the upper block 302, which enables the respective blades 308, 312 to come together.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

What is claimed is:

1. A shear ram system, comprising an upper block coupled to a first arm, the upper block positioned to transition from a first location outside a bore to a second location within the bore, the upper block comprising a blade control arm having a first contact surface extending along a first length;

a lower block coupled to a second arm, the lower block positioned to transition from the first location outside the bore to the second location within the bore, the lower block comprising a second contact surface positioned proximate the first contact surface; and a progressive gap between the first contact surface and the second contact surface, the progressive gap being larger at a first end than at a second end such that a first gap distance at the first end is greater than a second gap distance at the second end.

2. The shear ram system of claim 1, wherein the blade control arm comprises a wear insert at the second end to maintain the progressive gap during a shearing operation.

3. The shear ram system of claim 2, wherein the first gap distance extends from the wear insert to the second contact surface.

4. The shear ram system of claim 1, wherein at least a portion of the first contact surface is arranged at a first downward sloped angle and at least a portion of the second contact surface is arranged at a second downward sloped angle.

5. The shear ram system of claim 4, wherein a first slope of the first contact surface is different than a second slope of the second contact surface.

6. The shear ram system of claim 1, further comprising a centralizer arranged on at least one of the upper block or the lower block.

7. The shear ram system of claim 6, wherein the centralizer is positioned on the lower block, the centralizer arranged radially outward from a blade of the lower block.

8. The shear ram system of claim 6, wherein the centralizer comprises a leading edge positioned at a first angle relative to a first axis, the first axis being a radial axis of the bore.

9. The shear ram system of claim 8, wherein the leading edge is positioned at a second angle relative to a second axis, the second axis being perpendicular to the first axis.

10. A blowout preventer, comprising:

a tubular fluidly coupled to a wellbore, the tubular having a bore; and a pressure control device positioned to extend into the bore, the pressure control device comprising:

an upper block arranged proximate the bore in a first position and within the bore in a second position, the upper block comprising a blade control arm having a first contact surface;

a lower block arranged proximate the bore in a first position and within the bore in a second position, the lower block comprising a second contact surface that faces the first contact surface; and a progressive gap between the first contact surface and the second contact surface, the progressive gap being larger at a first end than at a second end such that a first gap distance at the first end is greater than a second gap distance at the second end.

11. The blowout preventer of claim 10, wherein at least a portion of the first contact surface is arranged at a first downward sloped angle and at least a portion of the second contact surface is arranged at a second downward sloped angle.

12. The blowout preventer of claim 11, wherein a first slope of the first contact surface is different than a second slope of the second contact surface.

13. The blowout preventer of claim 10, further comprising a centralizer arranged on at least one of the upper block or the lower block.

14. The blowout preventer of claim 13, wherein the centralizer is positioned on the lower block, the centralizer arranged radially outward from a blade of the lower block.

15. The blowout preventer of claim 10, wherein the progressive gap maintains a space between the first contact surface and the second contact surface when the upper block has a wellbore force applied.

16. The blowout preventer of claim 10, further comprising a wear insert arranged on the blade control arm, the wear insert contacts at least a portion of the second contact surface when the upper block and the lower block are transitioned between the first position and the second position and at least partially maintains the progressive gap.

17. The blowout preventer of claim 16, wherein the wear insert is formed from a softer material than at least one of the upper block or the lower block.

18. A blowout preventer, comprising:

a tubular fluidly coupled to a wellbore, the tubular having a bore; and a pressure control device positioned to extend into the bore, the pressure control device comprising:

an upper block adapted to translate into the bore, the upper block comprising a first contact surface;

a lower block adapted to translate into the bore, the lower block comprising a second contact surface, wherein the first contact surface and the second contact surface are opposite facing;

a progressive gap between the first contact surface and the second contact surface, the progressive gap formed when the first contact surface and the second contact surface complete a shearing stroke, wherein a first gap distance at a first end of the first contact surface is greater than a second gap distance at a second end of the first contact surface; and a wear insert arranged on the lower block, the wear insert contacting at least a portion of the upper block during the shearing stroke, the wear insert at least partially maintaining the progressive gap.

19. The blowout preventer of claim 18, further comprising a centralizer arranged on at least one of the upper block or the lower block.

20. The blowout preventer of claim 19, wherein the centralizer is positioned on the lower block, the centralizer arranged radially outward from a blade of the lower block.

* * * * *